United States Patent [19]

Brenholdt

[11] 4,454,991

[45] Jun. 19, 1984

[54] APPARATUS AND METHOD FOR MONITORING AND CONTROLLING A DISC REFINER GAP

[75] Inventor: Irving R. Brenholdt, Stratford, Conn.

[73] Assignee: St. Regis Paper Company, West Nyack, N.Y.

[21] Appl. No.: 351,373

[22] Filed: Feb. 22, 1982

[51] Int. Cl.[3] ..... B02C 7/14

[52] U.S. Cl. ..... 241/30; 241/37; 241/259.2

[58] Field of Search ..... 241/30, 37, 259.1, 261.2, 241/259.2, 33, 259.3, 36, 261.3

[56] References Cited

U.S. PATENT DOCUMENTS

| | | |
|---|---|---|
| 2,548,599 | 4/1951 | Garr . |
| 2,941,732 | 6/1960 | Cross et al. . |
| 3,133,707 | 5/1964 | Zimmerman . |
| 3,434,670 | 3/1969 | May . |
| 3,436,654 | 4/1969 | Thiele et al. . |
| 3,468,488 | 9/1969 | Karper et al. . |
| 3,799,456 | 3/1974 | Jewell et al. . |
| 3,928,796 | 12/1975 | Kaimer . |
| 3,944,146 | 3/1976 | Stockmann et al. . |
| 4,073,442 | 2/1978 | Virving . |
| 4,251,035 | 2/1981 | Chatwin et al. . |

*Primary Examiner*—Mark Rosenbaum
*Attorney, Agent, or Firm*—Joseph M. Maguire

[57] ABSTRACT

An apparatus and method for dynamically monitoring the gap between the refining surfaces of first and second relatively rotating metallic refining members. At least one of the refining members is mounted to a first rotatable shaft which is supported in a housing by lubricated bearing means. When the refining members are in rotating relation, an electrical impedance exists across the gap. The value of the impedance is dependent on the size of the gap. An alternating electrical current is passed through the gap and the voltage across the gap is monitored to provide an indication of the size of the gap. The voltage across the gap can also be used as one input to a circuit which controls the size of the gap by driving an electro/hydraulic system.

29 Claims, 7 Drawing Figures

APPARATUS AND METHOD FOR MONITORING AND CONTROLLING A DISC REFINER GAP

BACKGROUND OF THE INVENTION

The present invention relates to an apparatus and method for monitoring the clearance ("gap") between the refining surfaces of first and second relatively rotating metallic members for refining fibrous cellulosic material. More particularly, the invention relates to a means for determining the gap on the basis of the electrical impedance across the gap and producing an electrical signal to drive a control system which maintains the gap at a desired size.

Cellulosic fibers must be subject to mechanical treatment before they can be made into paper. This treatment may be applied in a number of different ways, but it generally includes a bruising, rubbing or crushing action on the fibers. The terms beating and refining are used in the paper industry to describe the operation of mechanically treating pulp fibers. Refining usually refers to a fiber separation and fiber cutting action.

In disc refining, two parallel discs rotate relative to one another with a space therebetween. The surfaces of the discs have refiner plates mounted thereto which provide a refiner surface and define the refiner gap. The refiner plates have a precise configuration of angled bars and grooves so that wood chips or pulp fed into the gap will be subjected to a refining action. The distance between the refiner plates (i.e., the gap size) and the pressure exerted on the material being refined can be regulated to vary the degree of refining action.

The material between the plates (e.g., wood chips or pulp) forms a "pad" which serves to prevent the opposed plate surfaces from contacting one another. Such contact, known as "plate clashing", destroys the precise configuration of angled bars and grooves of the opposed plates and causes a degradation in the quality of the refining action. If the damage to the plates is extensive, the disc refining apparatus must be shut down and the damaged plate segments must be replaced.

Various techniques for preventing plate clashing are known in the art. These techniques have been developed to eliminate the costly down-time which results from plate clashing, and to maximize the amount of product which is refined by the disc refiner. For example, in U.S. Pat. No. 2,548,599, clearance control between the two refining plates of a rotary disc pulp refiner is provided by monitoring a magnetic flux path wherein the reluctance is determined by the space between the plates. Another magnetic arrangement for use in measuring plate separation in disc refiners is disclosed in U.S. Pat. No. 3,434,670. In this patent, a plurality of sensing coils are spaced around the periphery of one of the discs and at least one magnet is mounted adjacent to the periphery of the other disc. Upon rotation of the discs relative to each other, current pulses are produced in the coils which have a value dependent upon the spacing between the sensing coil and the magnet.

Other clearance control systems which are known include that shown in U.S. Pat. No. 3,799,456 which utilizes a pair of linear displacement transducers to produce voltages related to the positions of refiner plate surfaces. The voltage outputs from the transducers are summed to produce a composite signal representing the distance betweeen the refining surfaces during a refining operation. It is also known to use ultrasonic measurement techniques for determining the adjustment of a crusher gap setting, as shown in U.S. Pat. No. 3,944,146.

U.S. Pat. No. 4,073,442 relates to an electrically controlled system for regulating the grinding space in a grinding apparatus. In this patent, the moisture in wood chips which are collected in the grinding space between two metallic grinding discs is utilized to produce a conductive coil. The resistance of this cell varies in response to fluctuations in the grinding space. In U.S. Pat. No. 3,133,707, a hydraulic shaft repositioning system is actuated in a gyratory crusher in response to a capacitive Wheatstone bridge circuit. Another capacitance control position indicator for a gyratory crusher is shown in U.S. Pat. No. 4,251,035.

Another gyratory clearance measuring means is disclosed in U.S. Pat. No. 3,436,654. In the apparatus of this patent, a foil is inserted between one of the crushing surfaces and the structure of the crusher. The foil is grounded and an electrical signal is supplied between ground and the crusher surfaces. The capacitance between the surfaces is measured by using a high frequency source and a measuring circuit connected to the surfaces through tuned resonant circuits. The apparatus disclosed in this patent requires the use of a separate foil electrode which is sandwiched between a fixed crushing surface and a moving crushing surface. The apparatus is not applicable to a situation where both crushing surfaces are moving.

It would be advantageous to provide a means for monitoring the gap spacing between two counter-rotating refiner discs. The apparatus to accomplish this should not require considerable installation costs and should be readily adapted for installation in existing disc refiners. Such an arrangement should provide an electrical output signal which is proportional to the gap between the counter-rotating discs without a requirement for modifying the existing equipment. The output signal should be capable of controlling, through an appropriate servo-system, the size of the gap.

The present invention relates to such an apparatus.

SUMMARY OF THE INVENTION

In accordance with the present invention, a system is provided for dynamically monitoring the gap between the refining surfaces of first and second relatively rotating metallic refining members. The first refining member is mounted to a first rotatable shaft supported in a housing by a lubricated bearing means. The second member has a refining surface spaced from that of the first member to form a gap having an electrical impedance thereacross when the members are in rotating relation to one another. The value of the impedance is dependent on the size of the gap. The system comprises oscillator means for producing a stable high frequency alternating signal. Means are provided for coupling the signal to the first member through the first rotatable shaft. Means are also provided for coupling the second member to provide a return path for the signal. Also, means coupled to the first member is provided which is responsive to the alternating signal for monitoring the size of the gap.

DETAILED DESCRIPTION OF THE INVENTION

Figure 1:
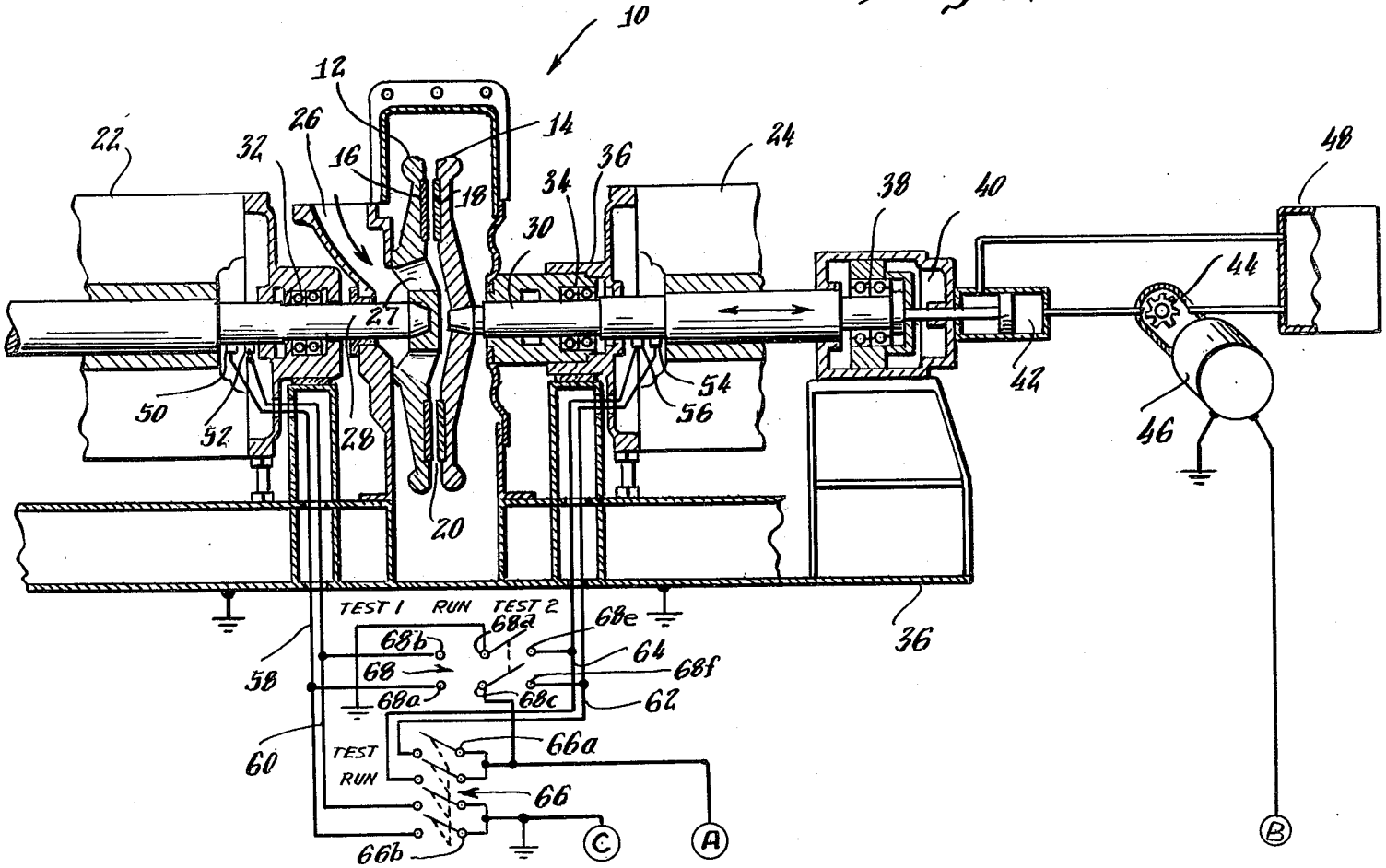
FIG. 1 is a drawing of a disc refiner embodying the present invention.

FIG. 1 shows disc refiner 10 having refiner discs 12 and 14. Refiner disc 12 has a bar and groove surfaced refiner plate 16 on the surface thereof. Refiner disc 14 has similar refiner plates 18 on the surface thereof. Refiner discs 12 and 14 are in parallel relation to one another, with a gap 20 between plates 16 and 18.

Refiner disc 14 is connected through a first shaft 30 to a motor 24. Motor 24 drives shaft 30 and hence, refiner disc 14 in a given, e.g., clockwise, direction. Refiner disc 12 is coupled to motor 22 through a second shaft 28. Motor 22 drives shaft 28, and hence refiner disc 12 in a direction, e.g., counterclockwise, which is opposite to the direction in which refiner disc 14 rotates. In an alternate embodiment, refiner disc 12 could be stationary, with only refiner disc 14 capable of being rotated.

First shaft 30 which drives refiner disc 14 is supported in an electrically conductive housing 36 by lubricating bearing 34. Second shaft 28 is supported in electrically conductive housing 36 by lubricated bearing 32. When the disc refiner is not in operation (i.e., the refiner discs are not rotating) first shaft 30 is electrically connected to second shaft 28 through bearing 34, conductive housing 36, and bearing 32.

It has been found that when the disc refiner is in operation (i.e., refiner discs 12 and 14 are rotating), there is a high electrical resistance between first shaft 30 and second shaft 28 to electrical potentials below 1 volt. This phenomenon has been traced to the action of lubricated bearings 34 and 32 which, when in motion, provide the high electrical resistance. The magnitude of this electrical resistance has been measured in a disc refiner and found to be on the order of 100,000 ohms. It is believed that the conductivity through such a lubricated bearing in motion is influenced by the momentary and microscopic breakdowns in the lubricating oil film. Assuming the number of such breakdowns to be relatively small in a bearing rotating at a high rotational speed, the high electrical resistance provided by such bearings is understandable. The bearings in a typical disc refiner operate at a rotational speed of about 1200 revolutions per minute.

It has also been found that the space between refiner plates 16 and 18 (i.e., gap 20) in disc refiner 10 shown in FIG. 1 can be treated as an electrical element having capacitance and conductance. Normal refiner operation may include momentary microscopic metallic contact between refiner plates 16 and 18 at a very high frequency. An averaging of these short circuit events together, with an averaging of capacitance, provides an effective electrical impedance that can be used to monitor and control the size of gap 20. As the size of gap 20 increases (i.e., the separation between refiner plates 16 and 18 becomes greater), the electrical impedance across gap 20 increases. Conversely, as the size of gap 20 is reduced, the electrical impedance thereacross is reduced.

Figures 4, 5A, 5B, 6:
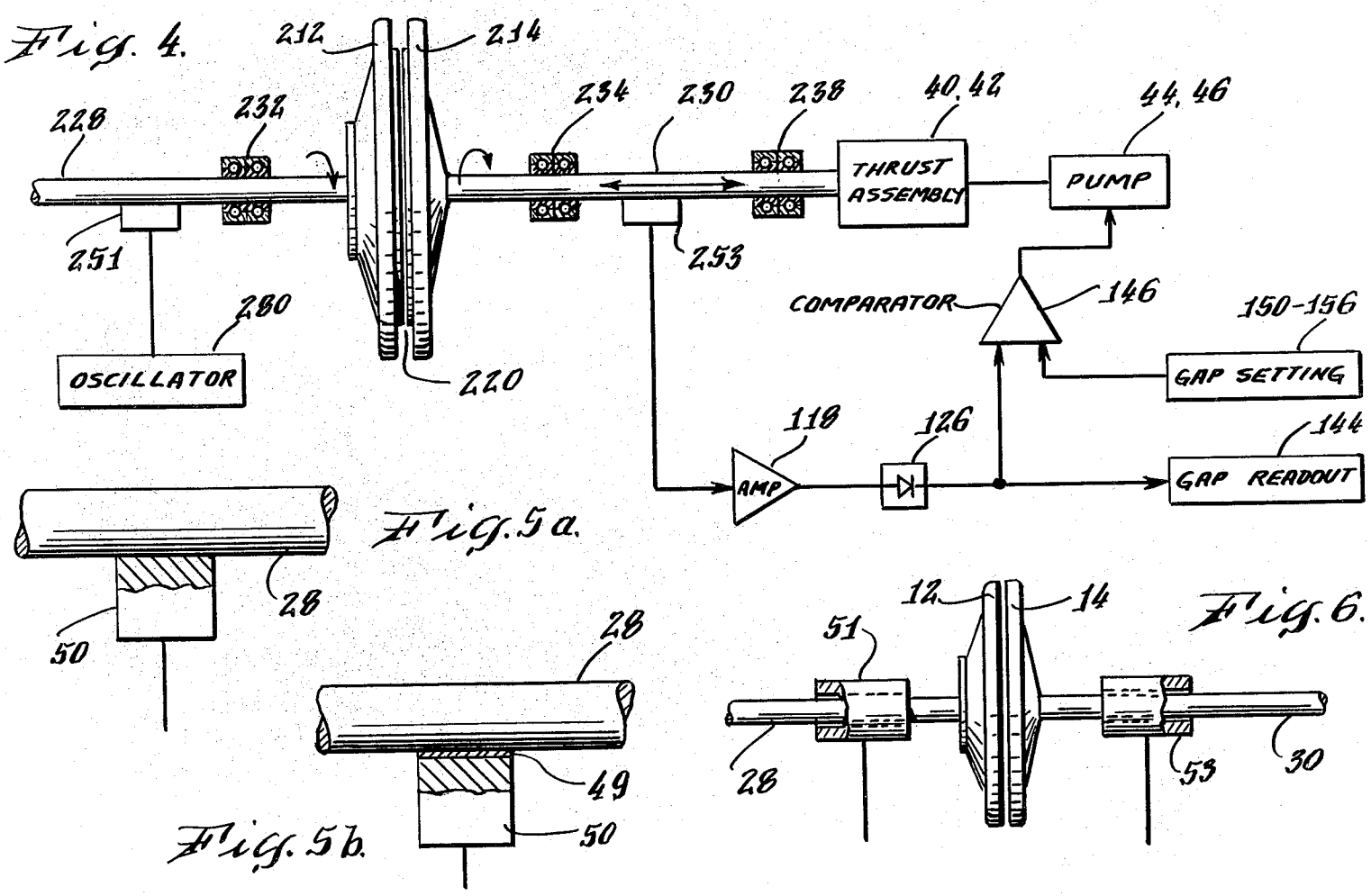
FIG. 4 is a simplified drawing of a disc refiner embodying an alternate embodiment of the present invention including a block diagram of circuitry used in conjunction therewith.
FIG. 5*a* is an enlarged view of an electrical brush arrangement used in one embodiment of the present invention.
FIG. 5*b* is an enlarged view of an electrical brush arrangement used in another embodiment of the present invention.
FIG. 6 is an enlarged view of an alternate coupling means which can be used in an embodiment of the present invention.

Electrical connections for use in monitoring the impedance across gap 20 are made through coupling means 54 and 56 to first shaft 30, and through coupling means 50 and 52 to second shaft 28. Coupling means 50, 52, 54 and 56 can be electrical brushes which make electrical contact with associated shaft 28 or 30 in a conventional manner as shown in FIG. 5*a*. Alternatively, coupling means 50, 52, 54 and 56 can capacitively couple to their associated shafts, if, for example, an insulating oil film 49 is situated between conventional electrical brushes and their associated shafts, as shown in FIG. 5*b*. Capacitive coupling to shafts 28 and 30 can also be accomplished through the use of metal collars 51 and 53, spaced from the shafts, as shown in FIG. 6. Since first shaft 30 is electrically connected to refiner disc 14 and hence, refiner plate 18, coupling means 54 and 56 are electrically coupled to refiner plate 18. Similarly, coupling means 50 and 52 are electrically coupled to refiner plate 16. As noted above, shafts 28 and 30, and hence refiner plates 16 and 18, are effectively shorted together through bearings 32, 34 and housing 36 when the disc refiner is not in operation. When the apparatus is in operation, however, refiner plates 16 and 18 will not be shorted together. Again, this result occurs because of the high resistance provided by lubricated bearings 32 and 34 when they are in motion.

Figure 2:
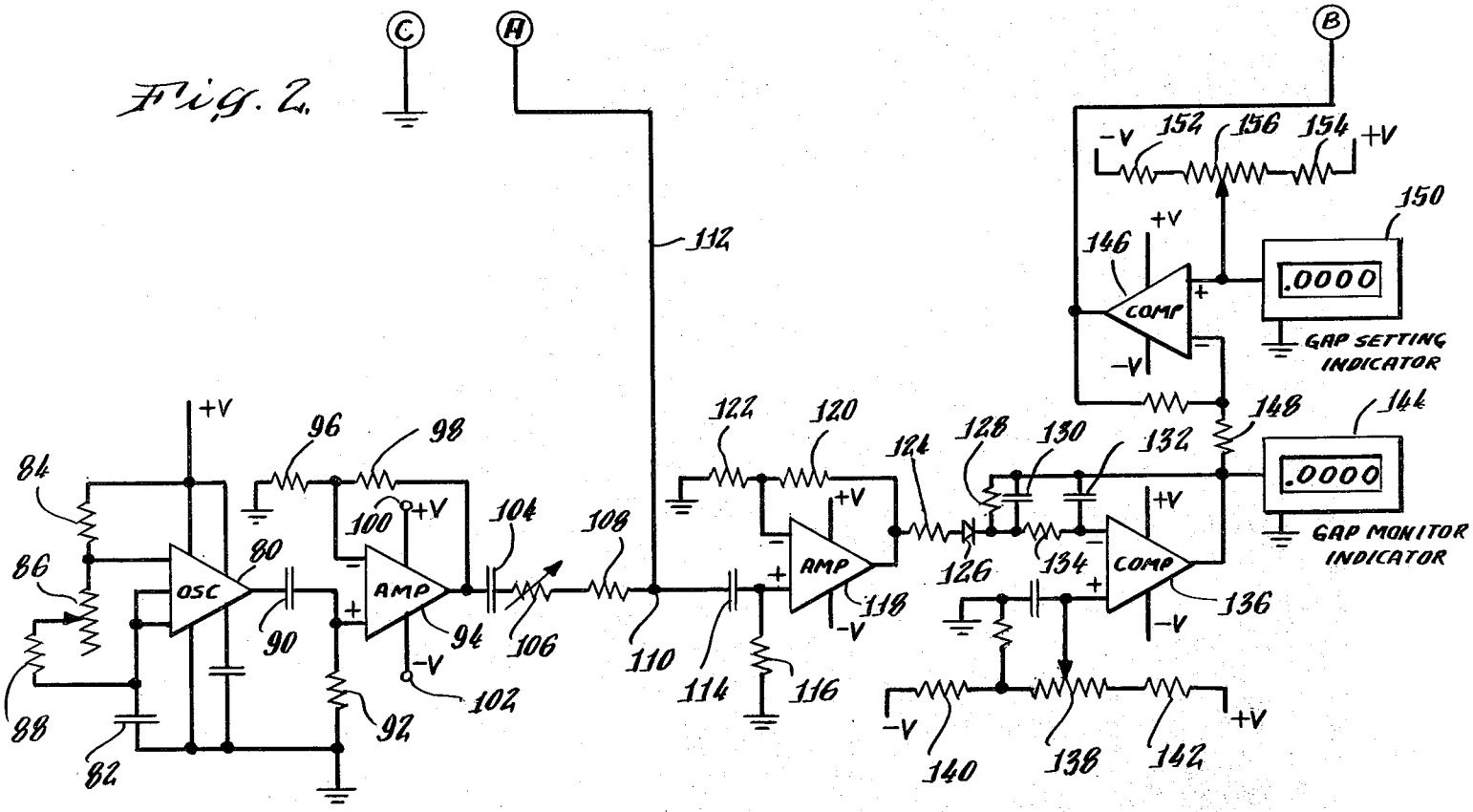
FIG. 2 is a schematic diagram of the electrical circuitry for use with the apparatus shown in FIG. 1.

The impedance monitoring and gap control circuitry can best be understood by reference to FIG. 2 in conjunction with FIG. 1. Node A of FIG. 2 is connected to node A in FIG. 1. Similarly, node B of FIG. 2 is connected to node B of FIG. 1. Node C of FIG. 1 and node C of FIG. 2 are connected to one another, indicating that the circuitry shown in the figures share a common ground.

Shown in FIG. 2 is an oscillator 80 which produces a stable high frequency alternating signal output. The frequency of oscillator 80 will preferably be high enough so that it can be distinguished from other spurious signals present in the refining environment. A typical frequency which can be used may be on the order of 30 KHz, in the case where coupling means 50, 52, 54, and 56 are electrical brushes making electrical contact with associated shaft 28 or 30. When capacitive coupling to shafts 28 and 30 is utilized, e.g. by the coupling means shown in FIG. 5*b* or FIG. 6, a much higher frequency, on the order of about 4 MHz is typically used. In the embodiment shown, the frequency of oscillator 80 is determined by the time constant of capacitor 82 and the sum of resistors 84, 86 and 88. The frequency may be altered by the adjustment of variable resistor 86. It is desirable to maintain the output of the oscillator at a stable amplitude and frequency. One way to achieve a stable output frequency would be through the use of a crystal, in a manner well known to those skilled in the art.

The output of oscillator 80 passes through a coupling capacitor 90 and through a load resistor 92. The output of oscillator 80 is also applied to an AC amplifier 94 from the junction of capacitor 90 with resistor 92. The gain of amplifier 94 is set by the ratio of feedback resistors 96 and 98. The amount of gain is selected so that amplifier 94 is saturated, i.e., the peak to peak output of amplifier 94 is equal to the difference between the voltages +V and −V at terminals 100 and 102 respectively. For example, if +V is 15 volts and −V is −15 volts, the peak to peak output of amplifier 94 when saturated will be 30 volts.

Amplifier 94 serves to increase the amplitude of the alternating signal produced by oscillator 80. The output of amplifier 94 passes through capacitor 104 to a variable resistor, or potentiometer 106 which is used in the calibration of the gap monitor circuitry. The adjustment of potentiometer 106 for calibration purposes will be explained below. The calibrated signal from potentiometer 106 passes through resistor 108 to node 110. The signal at node 110 is essentially the stable high frequency alternating signal from oscillator 80 with its amplitude set at a desired magnitude. This signal is carried on wire 112 to a pair of switches 66 and 68, shown in FIG. 1. In operation, these switches are in their "run" positions. Switch 68 is a double throw, double pole, center-off switch. The switch is in the "run" position when it is turned off.

Switch 66 is a four pole single throw switch which is in its "run" position when it is turned on.

In operation, with switches 66 and 68 in their "run" positions, current from resistor 108 will flow on wire 112 through section **66*a* of switch 66 to wires 62 and 64. The current from wires 62 and 64 will flow to coupling means 54 and 56 respectively. Current will be applied by coupling means 54 and 56 to first shaft 30, and will continue through shaft 30 to refiner disc 14, refiner plate 18, across gap 20 to refiner plate 16, to refiner disc 12, through second shaft 28, and to coupling means 50 and 52. From coupling means 50 and 52, the current flows through wires 58 and 60 respectively, to section 66*b* of switch 66**, and from there to ground.

When the disc refiner is in operation, bearings 32 and 34 will be in motion and thus, first shaft 30 will not be short circuited to second shaft 28. Calibration potentiometer 106 is chosen such that the voltage across gap 20 when the refiner is in operation will be approximately 1/10 volt. Current flowing through bearings 32 and 34, therefore, will not exceed 1 microampere, assuming the electrical resistance of the bearings to be about 100,000 ohms. When the machine is running, cellulosic material is fed from conduit 26, through opening 27 in refiner disc 12, and into the space between refiner discs 12 and 14. The counter rotating motion of refiner discs 12 and 14 will force the cellulosic material into gap 20, between refiner plates 16 and 18. The impedance across gap 20, with the cellulosic material therewithin, will change as a function of the gap size. This change in impedance will cause the voltage appearing on refiner disc 14 (and hence at coupling means 54 and 56) to vary in proportion to the size of gap 20.

The change in voltage appearing at coupling means 54 and 56, in response to the gap size, will appear on wire 112. This voltage is transferred from wire 112 through coupling capacitor 114 to resistor 116. The voltage is also transferred to the input of AC amplifier 118 from the junction of capacitor 114 and resistor 116. Resistor 116 can be replaced with an inductor to provide filtering, so that AC amplifier 118 receives only the oscillator frequency, and not the other spurious signals which may be present. The voltage gain of amplifier 118 is determined by the ratio of the negative feedback resistors 120 and 122. The voltage gain is typically adjusted so that the output voltage will be on the order of 5 volts AC. This output voltage is fed through resistor 124 to diode 126. Diode 126 provides half-wave rectification to the output from amplifier 118, thereby producing a proportional DC voltage across resistor 128 which is filtered by a network comprising capacitors 130 and 132 along with resistor 134. The DC voltage is further smoothed by the action of DC comparator/amplifier 136.

DC comparator/amplifier 136 has one input connected to the rectified, filtered output of amplifier 118. The other input to DC comparator/amplifier 136 is connected to a variable reference voltage. A negative supply voltage is connected to one end of resistor 140. A positive supply voltage is connected to resistor 142. Potentiometer 138 is in series relation between resistors 140 and 142, providing the variable reference voltage for DC comparator/amplifier 136. The output of DC comparator/amplifier 136 is connected to a gap monitor indicator 144.

Gap monitor indicator 144, which may, for example, be a light emitting diode ("LED") display, serves to provide a visual indication of the instantaneous gap size being monitored by the circuitry of FIG. 2. Gap monitor indicator 144 is calibrated by simulating a closed refiner gap or short circuit between refiner plates 16 and 18. This is done by placing switch 68 in the TEST 1 position such that terminals **68*a* and 68*b* are connected to their respective counterparts 68*c* and 68*d*. Switch 66 is left in the run position. Under these conditions, wire 112 is effectively grounded, and potentiometer 138 is set to produce a reading of zero on gap monitor indicator 144**.

Once the apparatus has been properly calibrated to correctly indicate a short circuit condition, it must be calibrated to provide proper readings when the disc refiner is in operation. This is done by running the refiner with gap 20 open to its known maximum position. This position is typically one-hundred thousandths (0.100) of an inch. Calibration potentiometer 106 is then adjusted so that the gap monitor indicator 144 will display the known maximum gap size (e.g., 0.1000). Once the apparatus has been so calibrated for its operating range, the gap size displayed by gap monitor indicator 144 at any given time will be accurate.

The apparatus described to this point is useful as a gap monitor in a disc refiner. The signal which drives gap monitor indicator 144 can also be used, in conjunction with additional circuitry, to automatically control the size of the gap. This can be accomplished by adding a second DC comparator/amplifier 146 as shown in FIG. 2.

The output from DC comparator/amplifier 136 is fed through resistor 148 to one input of DC comparator/amplifier 146. The other input of DC comparator/amplifier 146 is connected to a variable reference voltage source comprising resistors 152 and 154 along with potentiometer 156, in a conventional manner. Gap setting indicator 150 is also connected to the reference voltage from potentiometer 156. Gap setting indicator 150, which can be an LED display, will display the desired gap size to which the apparatus is currently adjusted. As will be appreciated by those skilled in the art, the desired gap size will be set by adjusting potentiometer 156, and hence the reference voltage supplied to gap setting indicator 150 and DC comparator/amplifier 146, to the desired level. The output of DC comparator- /amplifier 146 will be a voltage representing the difference between the gap setting desired and the actual gap size as indicated on gap monitor indicator 144.

The output of DC comparator/amplifier 146 drives a motor 46 as shown in FIG. 1. Motor 46 is connected to pump 44 which acts in a hydraulic circuit comprising hydraulic tank 48 and bidirectional piston controlled hydraulic actuator 42. Thus, motor 46, in response to the output of DC comparator/amplifier 146, will drive pump 44 to push the piston in actuator 42 in a given direction depending on the polarity of the output voltage.

The piston in actuator 42 is mechanically coupled to drive bidirectional thrust assembly 40, and hence first shaft 30, longitudinally along the axis of first shaft 30. A bearing 38 serves to support first shaft 30 within bidirectional thrust assembly 40. Thus, motor 46 and pump 44 can be utilized to adjust the size of gap 20 in disc refiner 10.

If the size of gap 20 is too small, motor 46 will be driven in a direction such that pump 44 moves the piston in actuator 42 further away from bidirectional thrust assembly 40. This will pull first shaft 30, and hence refiner disc 14 away from refiner disc 12, increasing the size of gap 20. On the other hand, if the size of gap 20 is too large, motor 46 will drive pump 44 in the other direction to push the piston in actuator 42, along with first shaft 30 and refiner disc 14 toward refiner disc 12.

It will now be appreciated that the refiner gap monitoring and control system of the present invention will automatically maintain a desired gap setting. The gap setting will be indicated on gap setting indicator 150. The actual size of the gap, at any given instant, will be displayed on gap monitor indicator 144. The size of the gap can be conveniently adjusted by varying the setting of potentiometer 156.

Another feature of the present invention is the ability to test the condition of coupling means 50, 52, 54 and 56. To test coupling means 50 and 52, switch 66 is placed in its test position so that no connections are made by switch 66 to any of wires 58, 60, 62, or 64. Switch 68 is then placed in its TEST 1 position so that terminal **68*a* is connected to 68*c* and terminal 68*b* is connected to terminal 68*d*. In this condition, current will flow from wire 112 through switch 68 to wire 58 and coupling means 50, and back through coupling means 52 and wire 60, through switch 68 to ground. If coupling means 50 and 52 are operating correctly, gap monitor indicator 144** will read "0.0000".

To test coupling means 54 and 56, switch 66 is placed in its test position (so that no connections are made to wires 58, 60, 62 or 64). Switch 68 is placed in its TEST 2 position so that terminal **68*c* is connected to terminal 68*f*, and terminal 68*d* is connected to terminal 68*e*. When in this condition, current will flow from wire 112 through switch 68 to wire 62 and coupling means 54, and back from coupling means 56 to wire 64, through switch 68 to ground. If coupling means 54 and 56 are operating correctly, gap monitor indicator 144** will read "0.0000".

Figure 3:
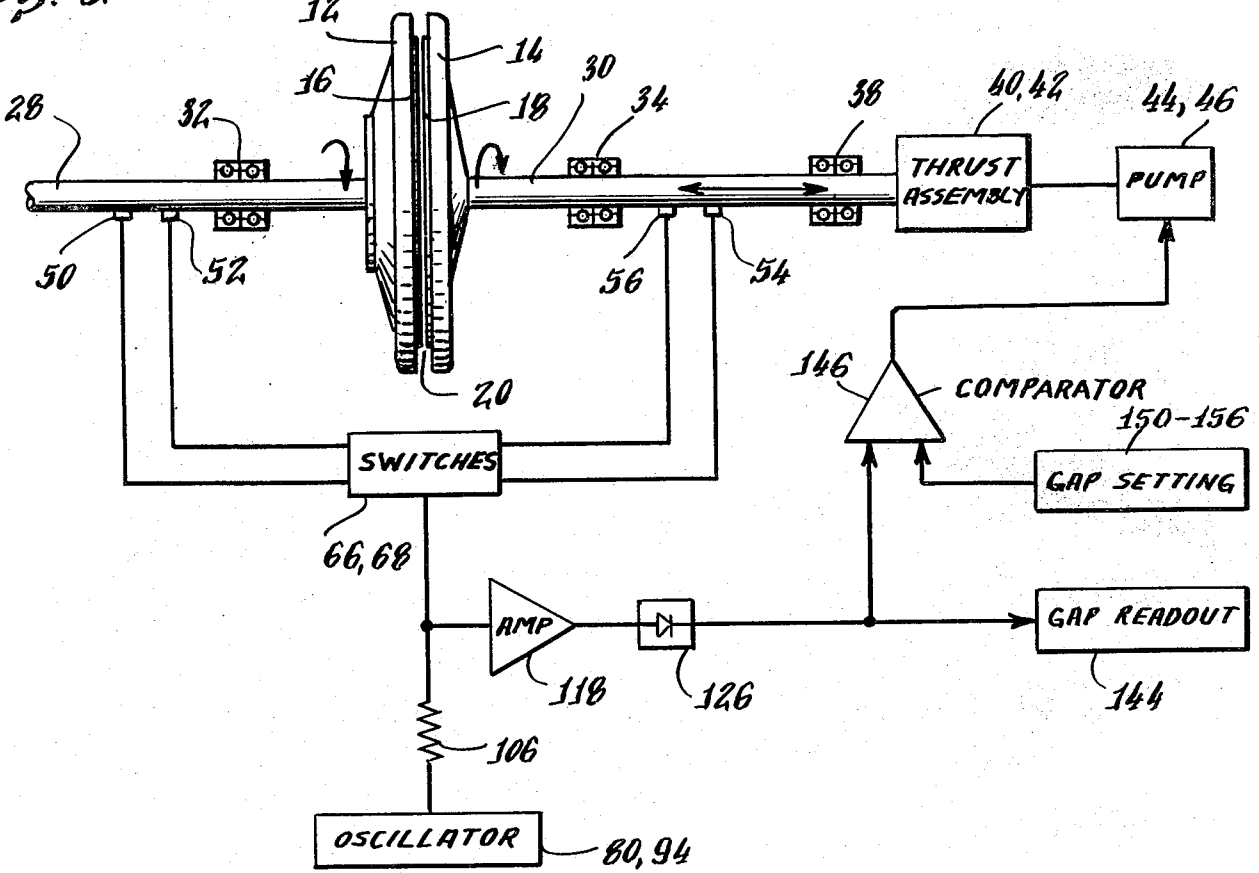
FIG. 3 is a simplified drawing of the disc refiner of FIG. 1 in combination with a block diagram of the circuitry shown in FIG. 2.

FIG. 4 shows an alternate embodiment of the present invention, wherein the signal from oscillator 280 is applied to a first shaft 228 through coupling means 251. The signal from oscillator 280 will then flow across gap 220 to second shaft 230. The resulting signal on shaft 230 will be indicative of the size of gap 220, and is applied to amplifier 118 through coupling means 253. Coupling means 251 and 253 may, as described earlier, comprise either electrical brushes or similar means for providing electrical contact (conductance) to shafts 228 and 230, respectively, or capacitive means, (e.g., brushes in conjunction with an oil film, or a collar) for providing capacitive coupling to shafts 228 and 230, respectively. Other coupling means will be apparent to those skilled in the art. The circuitry shown in block diagram form in FIG. 4 is essentially the same as that, having like numerals, shown in FIGS. 2 and 3 and described hereinabove. An advantage of the embodiment shown in FIG. 4 is that the signal from oscillator 280 flows directly through gap 220, and hence, the resulting signal on shaft 230 which is applied to amplifier 118 will be directly proportional to the gap size, thereby minimizing potential errors due to extraneous coupling impedances.

It will be appreciated by those skilled in the art that although the operation of the present apparatus has been described in terms of various currents and voltages, minor modifications can be made so that where voltages have been recited, currents can be used, and vice-versa.

I claim:

1. In a refining apparatus including first and second counter-rotating electrically conductive refining members with spaced refining surfaces facing one another to form a gap in which material can be refined, and means for rotating said first and second members, respectively, on first and second electrically conductive shafts supported in a housing by lubricated bearing means, the improvement comprising:

oscillator means for producing a stable high frequency alternating signal;

first means for coupling said alternating signal to one of said first or second shafts;

second means for coupling the other one of said shafts to a return circuit path to provide a complete circuit for said alternating signal across the electrical impedance of said gap; and means coupled to said circuit for monitoring the size of said gap in accordance with the effects of the electrical impedance of said gap upon said signal.

2. The system of claim 1 wherein said signal is an electric current which produces a voltage across said gap, the magnitude of said voltage being representative of the size of said gap.

3. The system of claim 1 wherein said signal is an electric voltage which produces a current through said gap, the magnitude of said current being representative of the size of said gap.

4. The system of claim 2 wherein said monitoring means is responsive to the magnitude of said voltage.

5. The system of claim 3 wherein said monitoring means is responsive to the magnitude of said current.

6. The system of claim 1 wherein said housing is electrically conductive and said lubricated bearing means, when in motion, provide, for low voltage potentials, a high resistance between said housing and said first and second shafts.

7. The system of claim 6 wherein said second means for coupling comprises an electrical brush having a film of insulating oil on the surface thereof, said oil being in communication with said second rotatable shaft, whereby said brush is capacitively coupled to said second rotatable shaft.

8. The system of claim 1 or 7 wherein said first means for coupling comprises a first electrical brush having a first film of insulating oil on the surface thereof, said first film of oil being in communication with said first rotatable shaft, whereby said first electrical brush is capacitively coupled to said first rotatable shaft.

9. The system of claim 6 wherein said second means for coupling comprises an electrically conductive member spaced from and forming a capacitor in conjunction with said second rotatable shaft.

10. The system of claim 1 or 9 wherein said first means for coupling comprises an electrically conductive member spaced from and forming a capacitor in conjunction with said first rotatable shaft.

11. The system of claim 6 wherein said second means for coupling comprises an electrical brush in communication with said second rotatable shaft.

12. The system of claim 1 or 8 wherein said first means for coupling comprises an electrical brush in communication with said first rotatable shaft.

13. The system of claim 11 further comprising switch means connected to said electrical brush for verifying proper communication between said electrical brush and said second rotatable shaft.

14. The system of claim 1 further comprising electrically actuated means for adjusting the size of said gap, and control means coupled between said monitoring means and said electronically actuated means for driving the latter to maintain said gap at a constant value.

15. The system of claim 14 wherein said control means comprises comparator means having a first input terminal coupled to said monitoring means, a second input terminal adapted to receive a reference signal thereon, and an output terminal coupled to provide a drive signal to said electrically actuated means.

16. The system of claim 15 wherein said electrically actuated means comprises a hydraulic pump controlled by an electric motor coupled to said output terminal of the comparator means, said pump being coupled through hydraulic means to said first rotatable shaft for moving said shaft longitudinally along its axis.

17. The system of claim 16 wherein said hydraulic means comprises a bidirectional piston controlled hydraulic actuator.

18. The system of claim 15 wherein said reference signal dictates the size to which said gap will be adjusted, said system further comprising indicator means responsive to said reference signal for providing an indication of the gap size dictated by said reference signal.

19. The system of claim 1 wherein said monitoring means comprises:

amplifier means having an input and an output, said input being coupled to the alternating signal;

rectifier means coupled to the output of said amplifier means for rectifying the amplifier alternating signal;

first comparator means for comparing the rectified signal to a reference signal and producing an output in accordance therewith; and indicator means responsive to the output of said first comparator means for providing an indication of said gap size.

20. The system of claim 19 further comprising electrically actuated means for adjusting the size of said gap, and control means coupled between the output of said first comparator means and said electrically actuated means for driving the latter to maintain said gap at a constant value.

21. The system of claim 20 wherein said control means comprises second comparator means for comparing the output of said first comparator means to a second reference signal and producing an output adapted to drive said electrically actuated means.

22. The system of claim 21 wherein said electrically actuated means comprises a hydraulic pump controlled by an electric motor coupled to the output of said second comparator means, said pump being coupled through hydraulic means to said first rotatable shaft for moving said shaft longitudinally along its axis.

23. The system of claim 1 further comprising means for calibrating said monitoring means by adjusting the amplitude of said alternating signal.

24. The system of claim 1 wherein said first means for coupling comprises an electrical brush in communication with said first rotatable shaft and further comprising switch means connected to said electrical brush for verifying proper communication between said electrical brush and said first rotatable shaft.

25. The system of claim 1 further comprising switch means for simulating an electrical short circuit across said gap to be used in calibrating said monitoring means.

26. A refining apparatus comprising first and second relatively rotating metallic refining members, said first member being mounted to a rotatable shaft supported in a housing by lubricated bearing means, and said second member having a refining surface spaced from that of said first member to form a gap having an electrical impedance thereacross when said members are in rotating relation, the value of said impedance dependent on the size of said gap, oscillator means for producing a stable high frequency alternating signal;

an electrical brush coupled to said oscillator means and having a film of insulating oil on the surface thereof in communication with said rotatable shaft for capacitively coupling the signal from said oscillator to said first member through said rotatable shaft;

means for coupling to said second member to complete, in series with said gap, a circuit path for said signal; and means coupled to said circuit path for monitoring the size of said gap in accordance with the effects of the impedance of said gap upon said signal.

27. A method for dynamically monitoring the gap between the refining surfaces of first and second relatively rotating metallic refining members, said first and second members being mounted to first and second rotatable shafts respectively, said shafts being supported in an electrically conductive housing by lubricated bearing means, said method comprising the steps of:

rotating said first and second members in opposite directions;

applying a stable high frequency alternating electric current to said first rotating member, said current being electrically isolated from said housing by the high resistance provided by the lubricated bearing supporting said first rotatable shaft;

providing a series return path for said current across said gap to said second rotating member and through said second rotating shaft; and monitoring the voltage across said gap to provide an indication of the size of said gap.

28. The method of claim 27 further comprising the steps of:

comparing a signal derived from the voltage across said gap to a reference voltage to produce a difference signal; and dynamically controlling the size of said gap by applying said difference signal to electro-hydraulic means for moving one of said rotatable shafts along its longitudinal axis.

29. The method of claim 28 further comprising the step of setting said reference voltage to a predetermined value to maintain said gap at a desired size.

* * * * *